US005381169A

United States Patent [19]

Arai et al.

[11] Patent Number: 5,381,169

[45] Date of Patent: Jan. 10, 1995

[54] INK JET APPARATUS WITH RECOVERY MECHANISM

[75] Inventors: Atsushi Arai, Kawasaki; Tetsuji Kurata, Yokohama, both of Japan

[73] Assignee: Canon Kabushiki Kaisha, Tokyo, Japan

[21] Appl. No.: 871,729

[22] Filed: Apr. 21, 1992

[30] Foreign Application Priority Data

Apr. 22, 1991 [JP] Japan ..... 3-090741

[51] Int. Cl.[6] ..... B41J 2/165

[52] U.S. Cl. ..... 347/33

[58] Field of Search ..... 346/140 R; B41J 2/165, B41J 3/04; 347/33

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,138,343 | 8/1992 | Aichi et al. | 346/140 R |
| 5,182,582 | 1/1993 | Okamura | 346/140 R |

FOREIGN PATENT DOCUMENTS

| | | | |
|---|---|---|---|
| 0362897 | 4/1990 | European Pat. Off. . | |
| 0364296 | 4/1990 | European Pat. Off. . | |
| 0409558 | 1/1991 | European Pat. Off. | B41J 2/165 |
| 0494693 | 7/1992 | European Pat. Off. | B41J 2/165 |
| 2549758 | 5/1977 | Germany . | |
| 54-56847 | 5/1979 | Japan | B41J 3/04 |
| 59-045162 | 3/1984 | Japan | B41J 2/165 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 0192646 | 10/1985 | Japan | B41J 3/04 |
| 62-101447 | 5/1987 | Japan | B41J 2/165 |
| 62-113554 | 5/1987 | Japan | B41J 2/165 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus has a carriage mounted with a recording head for conducting desired recording by discharging ink droplets onto a recording medium, a wiping member which comes in contact with the discharge-port surface of the recording head and makes a relative movement for wiping the discharge-port surface, and a cap member which comes in contact with the recording head for providing a capping state. The ink jet recording apparatus is characterized in that the carriage has a groove portion in a region adjacent to the recording head, the wiping surface side of the wiping member sliding on a part of the groove portion, and the cap member is provided, in a region adjacent thereto, with ink absorbing member which comes in contact with the groove portion.

8 Claims, 7 Drawing Sheets

INK JET APPARATUS WITH RECOVERY MECHANISM

BACKGROUND OF THE INVENTION

1. Field of the Invention

The present invention relates to an ink jet apparatus which discharges ink droplets onto a recording medium for recording and has means for cleaning a wiping member used for cleaning a recording head.

2. Related Background Art

Office equipment such as computers, word processors, copying machines, etc. has been in wide use in recent years; many recording systems for their recording apparatuses have been developed. Ink jet recording apparatuses have excellent features such as easier implementation of high definition, higher speed, improved quietness, and lower cost as compared with other recording systems. However, since in an ink jet recording system, ink droplets are discharged from a recording head onto a recording medium such as paper and OHP film for recording, fine ink droplets other than discharged primary ink droplets and splashes of ink droplets discharged onto a recording medium cause so-called ink mist or the like to adhere to the discharge-port surface of a recording head; if such ink mist accumulates in a large amount around a discharge port, a discharged ink droplet is dragged by the ink around a discharge port, causing the ink droplet to be discharged in an unexpected direction different from an expected flying direction (so-called discharge deviation) and in an extreme case, a failure to discharge an ink droplet (so-called nondischarging) with a resultant deterioration in printing quality. The ink jet recording system, therefore, employs a construction that a blade formed with an elastic member such as rubber slides on a discharge-port surface for wiping off unnecessary ink droplets. If such an elastic member is employed for cleaning, at the time of wiping the discharge-port surface of a recording head, a part of wiped-off ink droplets may be splashed within a recording apparatus caused by a restoring force when the blade parts from the discharge-port surface. Also, many of wiped-off ink droplets remain adhering to the blade. If ink is left adhering to the blade, some ink is left unwiped in the next wiping operation; consequently, cleaning effect can be reduced by half, causing the aforementioned problem. Also, ink water evaporates from ink remaining adhering to the blade, causing ink viscosity to increase; as a result, foreign matter such as paper dust further adheres to the remaining ink and accumulates. If the next wiping operation is conducted under such condition, the ink with increased viscosity and foreign matter may transfer to the discharge-port surface, causing a discharge malfunction such as nondischarging or discharge deviation. Moreover, in a recording apparatus having two or more recording heads for color image recording, for example, by using ink in different colors, there has been a problem that ink which has transferred to a blade in first wiping mixes with ink of a recording head of different ink color in the next wiping of the recording head, causing a deterioration in image quality. Also, in a color ink jet recording apparatus in such construction that one blade wipes out a plurality of heads, the amount of ink adhering to the blade increases, causing an increase in adverse effect of blade contamination.

In order to solve such problems, proposed are many constructions such as a construction that the movement of a carriage is utilized for sliding an ink absorbing body against the cleaning surface of a cleaning blade after head cleaning and thereby absorbing adhering ink from the blade, a construction that in color recording, ink cleaning is conducted in the order of color deepness, from light to deep, a construction that each head is provided with a dedicated blade, and so on.

However, in the blade ink absorbing type, the installation location of an absorbing body is limited to a head carriage or the like; consequently, an absorbing body size is limited, causing a high likelihood of deterioration in capability of the ink absorbing body over in long-term use. Also, in the dedicated blade type, an increase in cost and the necessity of a large space cause an apparatus size to increase, and therefore, this type is not preferable.

Disclosed in Japanese Laid-Open Patent Application No. 62-113554 is the function of a porous body for blade cleaning and a construction that the blade cleaning porous body is brought into contact with another porous body in a home position for ink transfer. Such construction, however, has not been utilized effectively because of insufficient ink transfer from the blade cleaning porous body to another porous body.

Furthermore, in an ink jet recording apparatus which uses a so-called permanent type head, i.e. a head which is not replaced during the service life thereof, the aforementioned cleaning mechanism needs to securely perform thereof over a long term; it cannot be said that a construction fully meeting such requirement has been established.

SUMMARY OF THE INVENTION

An object of the present invention is to provide an ink jet apparatus having a cleaning member whose cleaning blade maintains a head cleaning characteristic over long-term use for good recording, and in particular, an ink jet apparatus having a plurality of recording heads for color recording with improved cleaning characteristic.

As a result of making every effort to achieve the aforementioned object, the present inventors have obtained a knowledge that a cleaning characteristic can be properly improved by employing a member provided adjacent to a recording head for removing ink from a cleaning blade and a member for absorbing the removed ink and transferring it to another place.

The inventors have also obtained a knowledge that an arrangement space can be saved and a good cleaning characteristic can be maintained without using a special sequence particularly by linking a blade cleaning member to the movement of a head carriage, the movement of a cap member, and the like.

The present invention is made on the basis of aforementioned knowledge and characterized in that in an ink jet recording apparatus having a carriage mounted with a recording head for conducting desired recording by discharging ink droplets onto a recording medium, a wiping member which comes in contact with the discharge port formed surface of said recording head and makes a relative movement for wiping the discharge port formed surface, and a cap member which comes in contact with said recording head for constructing a capping state, said carriage has a groove portion in a region adjacent to said recording head, the wiping surface side of the wiping member sliding against a part thereof, and said cap member is provided, in a region adjacent thereto, with an absorbing member having ink absorbing property which comes in contact with said groove portion.

Thus, constructed is an ink jet recording apparatus in which a wiping member is securely cleaned, thereby maintaining a stable discharge characteristic over a long term.

DESCRIPTION OF PREFERRED EMBODIMENTS

[First embodiment]

Next, an embodiment to which the present invention is applied is specifically described with reference to the drawings. The present invention is not limited to embodiments to be described below, but includes various constructions as far as such constructions are included in the claims of the present invention.

Figure 1:
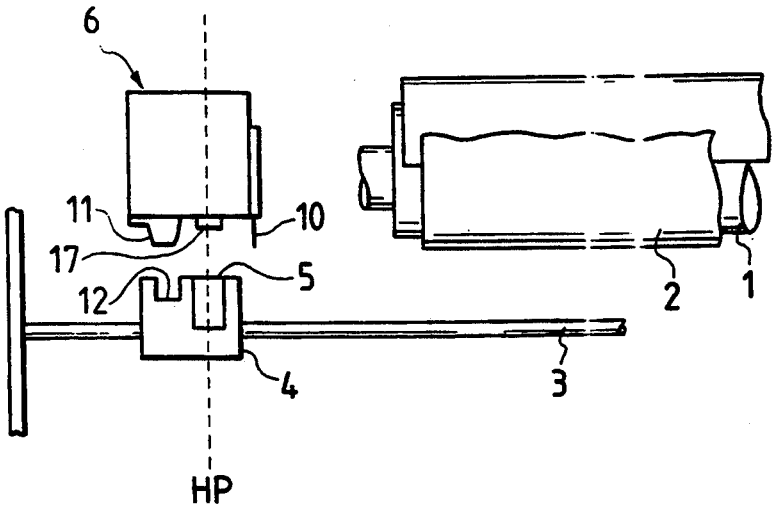
FIG. 1 is a partial plan view schematically showing the construction of the essential portions of an embodiment of an ink jet recording apparatus according to the present invention.
Figure 2:
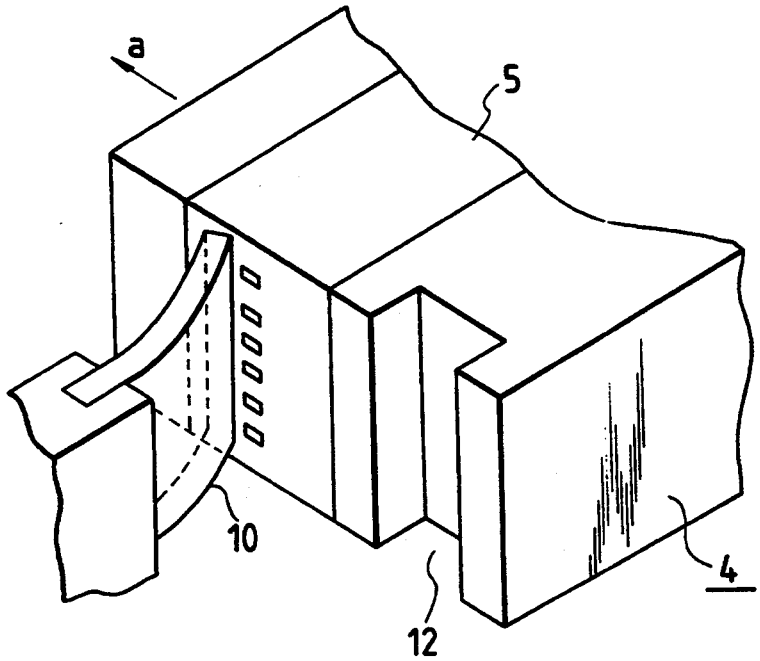
FIG. 2 is a partially enlarged perspective view showing the cleaning operation of an elastic blade of a recording apparatus.
Figure 3:
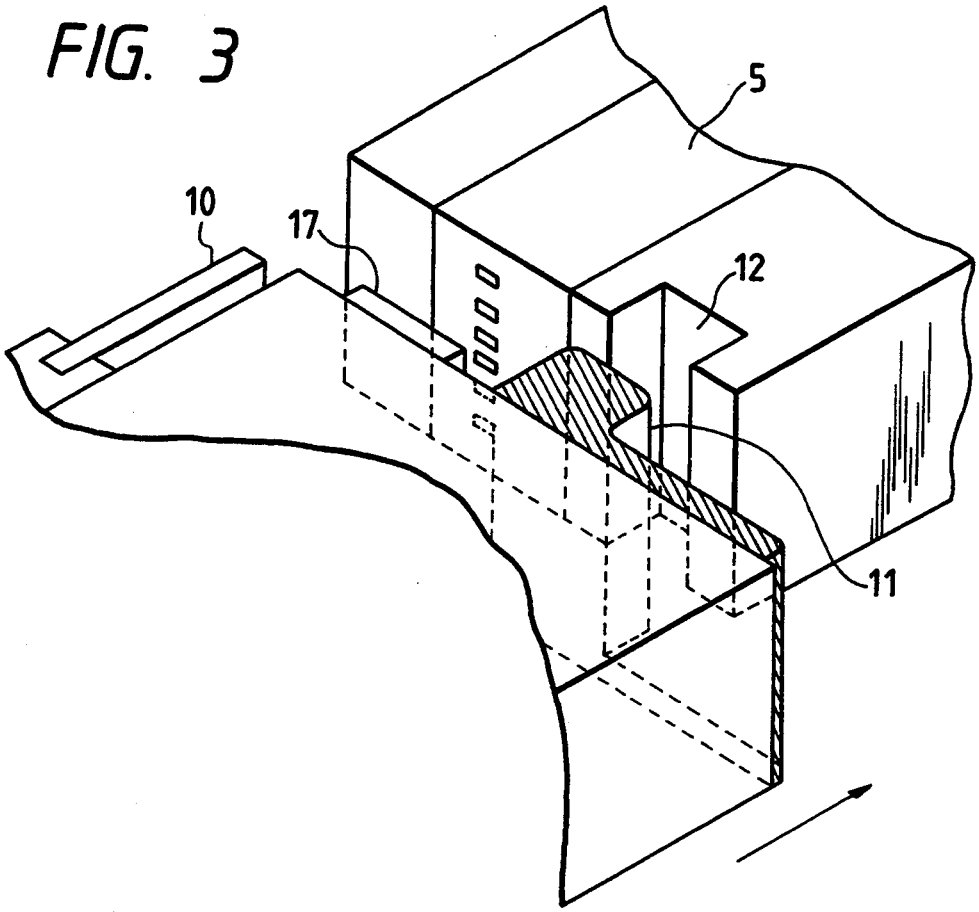
FIG. 3 is a partially enlarged perspective view showing the capping operation of a recording apparatus.

FIGS. 1, 2 and 3 are views schematically showing the essential portions of an ink jet recording apparatus according to the present invention; FIG. 1 is a partial plan view of an ink jet apparatus; FIG. 2 is a perspective view showing the state where an elastic blade 10 in FIG. 1 is wiping a recording head 5 mounted on a carriage 4, a groove 12 provided therein, of the present invention; and FIG. 3 is a partial perspective view showing the state where a capping unit, an absorbing member 11 disposed thereabout, of the present invention is operating for capping a recording head being stationary in a home position HP.

In FIG. 1, a guide shaft 3 is disposed ahead of a recording material 2 such as paper or plastic sheet backed up by a platen 1, and a recording means (recording head) 5 is mounted on the carriage 4 which moves along said guide shaft 3. The recording head has, for example, an electrothermal conversion element as a discharge pressure generating element for discharging ink from a discharge port, and utilizes thermal energy generated by said element for causing a state change of ink to occur, thereby discharging ink. The recording means 5 is fixed on the carriage 4 and is supplied with ink through an ink tube from an ink tank provided within an apparatus. The recording means 5 is a so-called permanent type recording head. The present invention described below can also be applied even to a cartridge type recording means which integrally has a recording head and an ink tank and is being removable from an apparatus for replacement.

Figure 5:
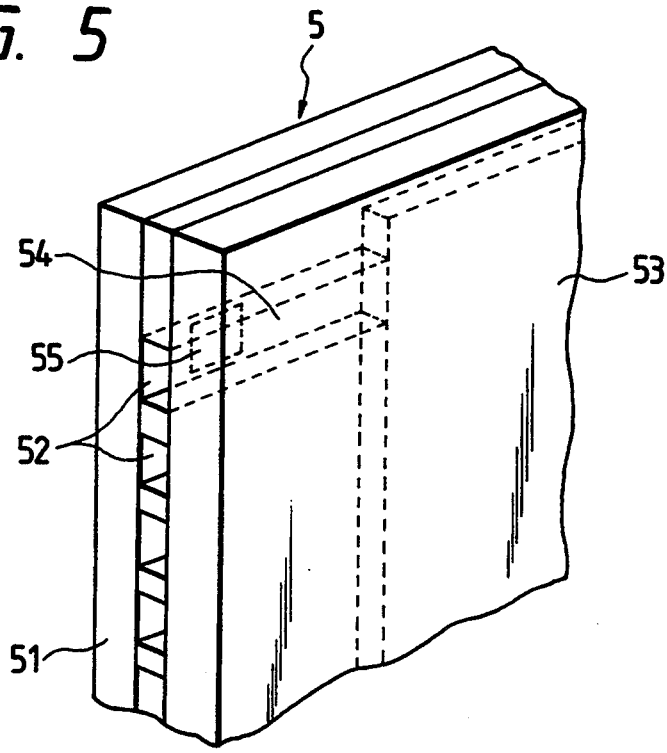
FIG. 5 is a schematic view showing the structure of an ink discharge portion of recording means in FIG. 1.

FIG. 5 is a partial perspective view schematically showing the structure of an ink discharge portion of said recording head 5. In FIG. 5, a plurality of discharge ports 52 are formed at a specified pitch on a discharge-port surface 51 facing said recording material 2 at a specified clearance (for example, about 0.5 to 1.5 mm) in between, and an electrothermal conversion body (heating resistor and the like) 55 is disposed for each ink path 54 connecting a common ink chamber and each discharge port 52. In an ink jet recording apparatus as shown in FIG. 1, said recording head 5 is mounted on said carriage 4 in such positional relation that said plurality of discharge ports 52 are arrayed in a direction crossing the main scanning direction (moving direction) of the carriage 4. Thus, the recording head 5 is constructed such that a corresponding electrothermal conversion body 55 is driven on the basis of an image signal or a discharge signal for boiling ink in a liquid path 54 and thereby causing a state change including bubble generation to occur, and consequently, a pressure derived from the state change causes ink to be discharged from the discharge port 52.

The carriage 4 which is mounted with said recording head 5 and scans along the guide shaft 3 has a concave groove portion 12 cut in a region adjacent to a recording head 5 mounted portion as the essential portions thereof are shown in FIG. 2. The groove portion 12, as described later, is provided so that after wiping the discharge port formed surface 51 of a recording head, the wiping surface of the blade 10 slides against the groove portion for scraping off adhering ink from the blade 10.

Figure 6:
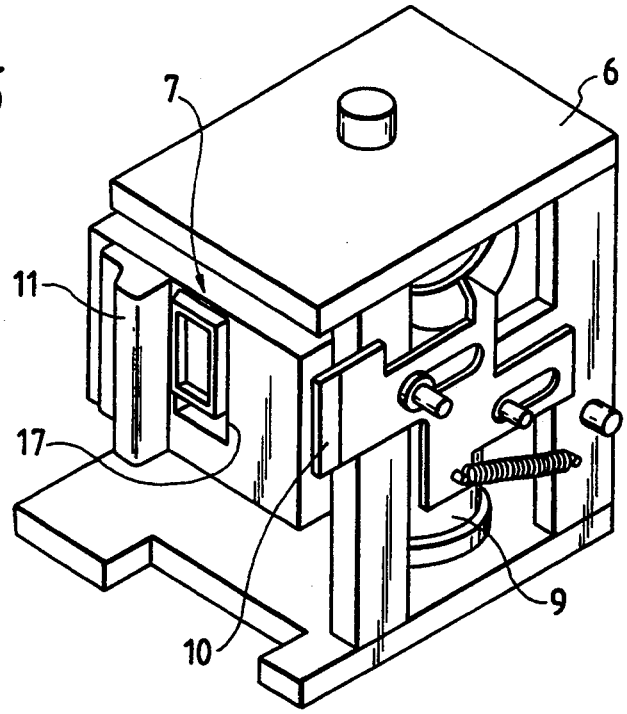
FIG. 6 is a perspective view showing a discharge recovery unit in FIG. 1.

In FIG. 1, a discharge recovery unit 6 of the recording head 5 is disposed in the home position HP of the carriage 4. FIG. 6 is a schematic perspective view of the discharge recovery unit 6. The discharge recovery unit 6 is disposed so as to be capable of moving forward toward and moving backward away from the recording head 5, and is equipped with a capping means 7 having a cap 17 capable of sealing the discharge port surface of the recording head 5 in a forward position and a pump 9 for sucking ink from the discharge ports 52 of the recording head 5 through said capping means 7 or sucking ink discharged into the cap. The capping operation and sucking recovery operation of the discharge recovery unit 6 are automatically conducted in association with or independent of the position of the carriage 4, or can be conducted by a user's switch operation.

In FIG. 6, the blade 10 having elasticity is provided on one side portion of the discharge recovery unit 6 for wiping out (hereinafter referred to as wiping) the discharge port adjacency (usually discharge port formed surface) of the recording head 5. The elastic blade 10 is provided so as to be capable of isolatedly moving forward or backward at the time of sucking recovery operation or at a specified point of time, and is constructed such that the movement of the carriage causes the blade to wipe out the discharge port surface 51 of the recording head 5 when the elastic blade is in a forward cleaning position. The absorbing member 11 is disposed in a specified position adjacent to the capping means 7 on the front of the discharge recovery unit 6, and is constructed so as to move forward together with the capping means at the time of capping. Then, the absorbing member presses against the groove portion 12 in the carriage 4 for absorbing scraped ink in said groove 12.

FIGS. 4A–4D schematically show the wiping process of the discharge port surface 51 of a recording head in an ink jet recording apparatus having the construction described above. When a wiping operation is to be conducted for cleaning the discharge port formed surface of a recording head at a specified timing during recording by a recording head or after sucking recovery to be conducted after recording has been completed, first, the carriage 4 mounted with the recording head 5 and controlled by a carriage drive control circuit 22 is brought to a standstill at the home position HP. Then, a recovery system drive control circuit 21 causes the wiping member 10 to move forward toward the carriage 4 and consequently, to De put in projected state.

Figure 4A:
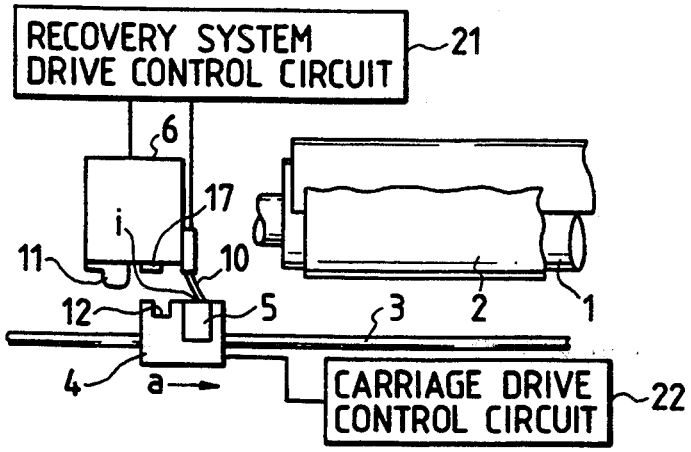
FIGS. 4A–4D are schematic diagrams sequentially explaining operation processes of a blade cleaning mechanism of an embodiment.
Figure 4B:
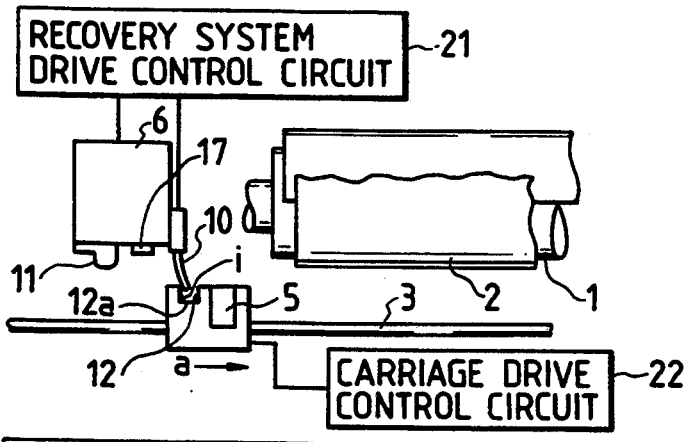
Figure 4C:
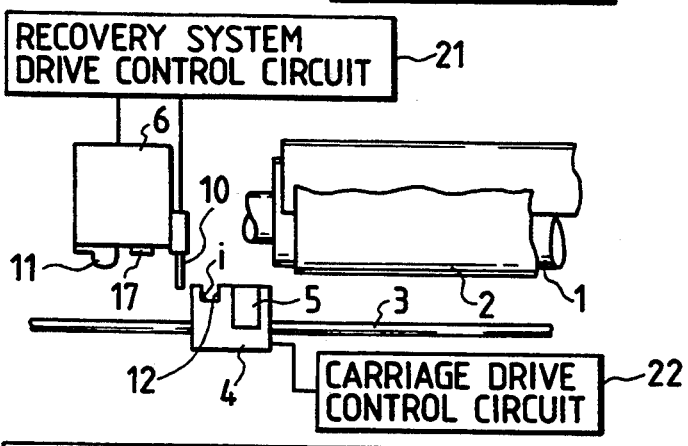
Figure 4D:
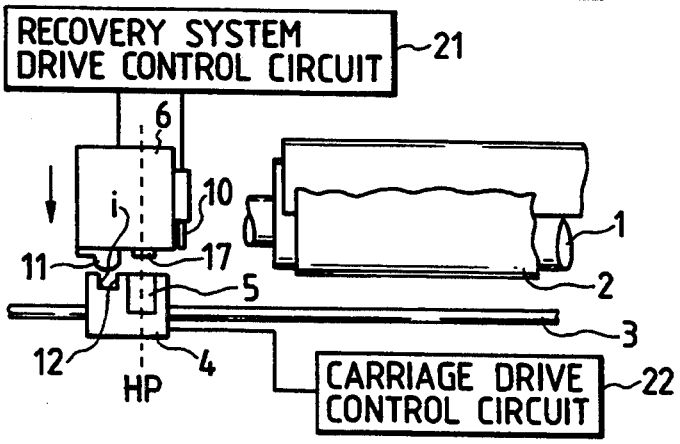

Next, as shown in FIGS. 2 and 4A, the carriage 4 is moved in the main scanning direction (direction of arrow a in the Figures). Going with the movement, the wiping member 10 slides or rubs against the discharge port formed surface 52 of the recording head 5 for removing foreign matter i such as ink, dust, and the like adhering to the discharge port surface 52. As the carriage 4 moves further in the direction of arrow a from the state of removing the foreign matter, the wiping member 10 slides against one side portion 12*a* of the groove 12 provided in the carriage 4 as shown in FIG. 4B. In other words, the wiping member 10 comes in contact with the one side edge portion 12*a* on the downstream side of the groove 12 in a wiping direction; as the wiping member 10 moves further in the direction of arrow a, the foreign matter i which has been removed from the recording head 5 and adhered to the wiping member 10 is scraped off by the edge portion 12*a* as shown in FIG. 4C, and consequently, the state as shown in FIG. 4C is established. Then, as shown in FIGS. 3 and 4D, the recording head carriage 4 is returned to the home position HP; at the time of capping (at the time of sucking recovery, at the time of capping during or after printing, and the like), the absorbing member 11 disposed around the cap (to the left of the cap in this example), together with the cap, moves forward and comes in contact with the groove portion 12 for absorbing the foreign matter i accumulated in the groove 12 for cleaning. The scanning of the carriage 4 and the driving of the capping means 7 or the wiping member 10 are controlled by the carriage drive control circuit 22 and the recovery system drive control circuit 21, respectively.

The absorbing member 11 disposed on the discharge recovery unit 6 enters and comes in contact with the groove portion 12 which has scraped off the adhering foreign matter i from the wiping member 10, and thus, the absorbing member 11 securely absorbs the foreign matter i scraped off in the groove portion 12. Hence, in spite of repeatedly conducted wiping operation, the wiping member 10 can always be held in clean state and can conduct reliable cleaning over a long term without a deterioration in performance thereof. Also, since the absorbing member 11 is disposed on the cap itself, the operation of sucking the foreign matter i in the groove portion 12 can be done by a capping operation; consequently, a special construction or sequence is not needed, and there causes no disadvantage to an apparatus.

Also, since the wiping member 10 is constructed such that a contact force is once relieved at the groove portion 12 provided substantially continuously to the front of the recording head 5 in the front of the carriage 4 mounted with the recording head 5, splashes of ink droplets and the like from the wiping member 10 caused by reaction thereof are all trapped in the groove portion 12, thus preventing the inside of an apparatus from being soiled with ink droplets or the like. Moreover, since a contact force of the wiping member 10 is again relieved after the foreign matter i has been scraped off at the groove portion 12, there are no splashes of the foreign matter i caused by reaction thereof, thus preventing the inside of an apparatus again from being soiled.

In our experiment using specified ink, a specified recording head (360 dpi, 64 nozzles), and an elastic blade made of polyurethane (0.7 mm in thickness, 10.0 mm in width, 8.0 mm in free length) at 1.5 mm in the amount of entry with respect to a head discharge port surface at the time of wiping and 200 mm/sec in a carriage moving speed, an endurance test was conducted on a recording apparatus having a recovery unit to which a construction of the present invention is applied, by printing 50000 sheets of size A4 at a recording rate of 100%, i.e. at an application quantity maximized by solid black recording, and on a cycle of one wiping operation per sheet and one capping operation with every 100 sheets; as a result, no discharge failure such as deviation and nondischarging occurred. However, as a result of an endurance test on an apparatus under the same conditions as described above except that a mechanism of the present embodiment was removed from a recovery unit, a discharge failure occurred after printing thousands of sheets. Thus, the use of a blade cleaning mechanism of the present invention has brought a great expansion of service life in terms of the number of sheets.

In the present embodiment, a groove portion is provided on the downstream side in a wiping direction. Also, when a groove is provided on the upstream side in a wiping direction, the same effect can be obtained, since an elastic blade is cleaned before wiping. However, as described before, it is preferable that the groove portion 12 be provided on the downstream side in a wiping direction for the reason that ink can be scraped off more easily from a blade because of scraping off wet (low viscosity) ink immediately after wiping. Needless to say, if a groove portion is provided on both sides, a much higher cleaning effect is obtained.

[Second embodiment]

FIGS. 7 to 10 show an embodiment of applying the present invention to an ink jet color recording apparatus having four recording heads which discharge ink in four colors (black, cyan, magenta, yellow), respectively.

In FIGS. 7 to 10, reference numerals and names of parts are the same as those in FIG. 1; however, a carriage 4 is mounted with four recording heads 5Y, 5M, 5C, and 5K, and a groove portion 12*a* is provided on the upstream side of the recording head 5Y in a wiping direction, and also, groove portions 12b, 12c, 12d, and 12e are provided on the downstream side of each head in a wiping direction, respectively. Also, a discharge recovery unit 6 is provided with four capping means 17Y, 17M, 17C, and 17K corresponding to said four recording heads; an absorbing body 11 in which openings are formed facing onto the capping means is disposed on substantially an entire head contact surface of the discharge recovery unit 6.

Also, each capping means 17 of the discharge recovery unit 6 is connected to an absorbing pump 9; the absorbing pump functions as a negative pressure generating source for collecting to a waste ink container (not shown) the ink which has been ejected into caps in an absorbing recovery process to be conducted in capping state, so-called preliminary discharge to be conducted before recording, and the like.

The absorbing body 11 of the present embodiment is not only provided on the entire surface of the discharge recovery unit 6 but extended as far as under a guide shaft 3 in a home position region. Thus, a space within an apparatus is utilized effectively for implementing the disposition and construction of the absorbing body 11 capable of absorbing a large amount of ink. Also, the absorbing body 11 provided under the guide shaft 3 functions as a proper absorbing body for ink which leaks, for some reason, from recording heads positioned in a home position.

In a recording apparatus of the present embodiment, the recording heads are constructed so as to incline at a specified angle of $\theta$ with a vertical direction. In a type basically assuming no head replacement (troubled heads can be replaced) and also conducting color recording, the amount of ink mist adhering to a head front increases, since the amount of discharged ink is large; however, such construction causes ink to be less likely to drop in the direction of gravity. In this example, the angle of inclination $\theta=30°$; however, the angle is not limited to 30°, but can be selected from a range of about 15° to 60°.

The construction and cleaning process of a color recording head cleaning unit according to the present embodiment will hereinafter be described with reference to FIGS. 8 and 9A–9D.

Figure 7:
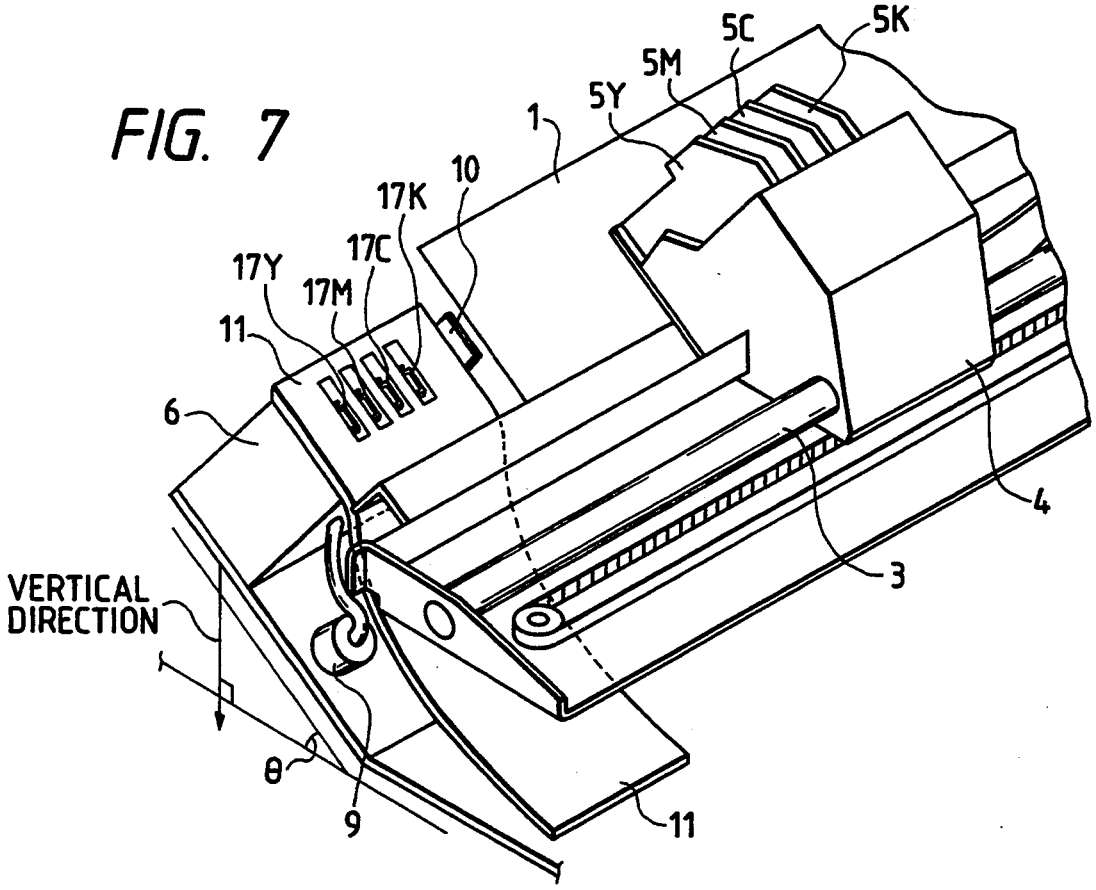
FIG. 7 is a perspective view schematically showing the construction of the essential portions of an another embodiment of an ink jet recording apparatus according to the present invention.
Figure 8:
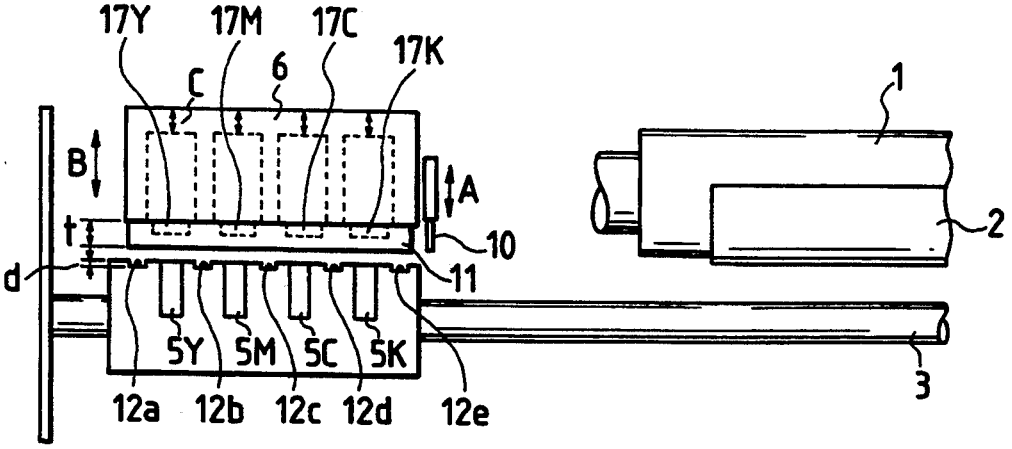
FIG. 8 is a partial plan view schematically showing a recovery unit of a recording apparatus.

FIG. 8 is a top view schematically showing a construction of FIG. 7 as viewed from above.

As shown in FIG. 8, the absorbing body 11 provided on the side of contact with a recording head 5 of the discharge recovery unit 6 has a specified thickness of t. Also, the groove portions 12a to 12e provided between recording heads and at both end portions of the carriage 4 mounted with four recording heads 5 have a specified depth of d.

In this example, t and d are specifically set as t=2.5 mm and d=0.5 mm. The positional relation between the absorbing member 11 and the cap member 17 is usually set such that the cap member 17 is positioned inside the absorbing member 11 as shown in FIG. 8. Also, in this example, a distance between the front of the recording head 5 and the front of the cap member (in actuality, the absorbing member 11) is set to about 2 mm.

The cleaning process of this example will be described with reference to FIGS. 9A–9D. A scanning control for the carriage 4 and a drive control for recovery system means such as the cap means 7 or the wiping member 10 are exercised by a carriage drive control circuit 22 and a recovery system drive control circuit 21, respectively.

Figure 9A:
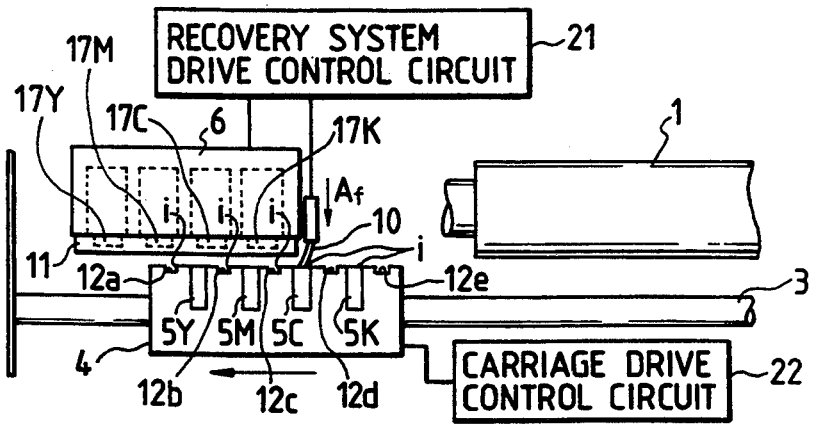
FIGS. 9A–9D are schematic diagrams sequentially explaining cleaning processes of an another embodiment.

First, as shown in FIG. 9A, at the time of terminating recording (which includes the termination of recording a specified line, and does not necessarily designate the termination of a complete recording process), the carriage 4 mounted with the recording heads 5 moves to a home position HP where the discharge recovery unit 6 is positioned. During the movement, since the cleaning blade 10 is in state after forward movement, i.e. in a cleaning position, the cleaning blade wipes off the fronts of the recording heads 5 and the carriage 4 which are coming to HP. During this cleaning, first, the blade 10 comes in contact with the groove portion 12a for cleaning the blade of ink mist, dust, and the like which has adhered thereto during wiping conducted before the present wiping process or during being left idle between a preceding process and the present process. Then, the blade cleans the recording head 5Y and then comes in contact with the groove portion 12b for scraping off at the groove portion 12b the ink which has been wiped off from the recording head 5Y. This process is repeatedly conducted at the recording heads 5M, 5C, and 5K in the order for transferring the ink wiped off from each recording head into the groove portions 12c, 12d, and 12e, respectively, in the carriage.

Figure 9B:
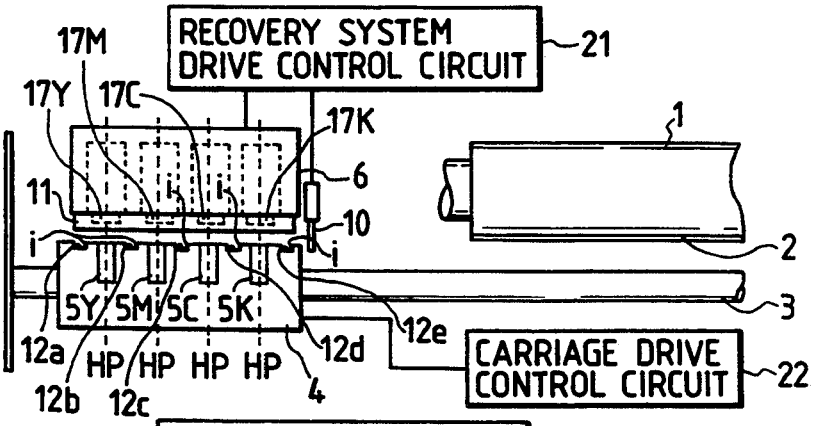

Next, as shown in FIG. 9B, at the time of the carriage 4's terminating movement to the home position HP, each recording head 5 faces each cap member 17 of the discharge recovery unit 6 and stops. At this time, the groove portions 12 hold adhering ink and the like which has transferred thereto as a result of wiping each recording head 5.

Figure 9C:
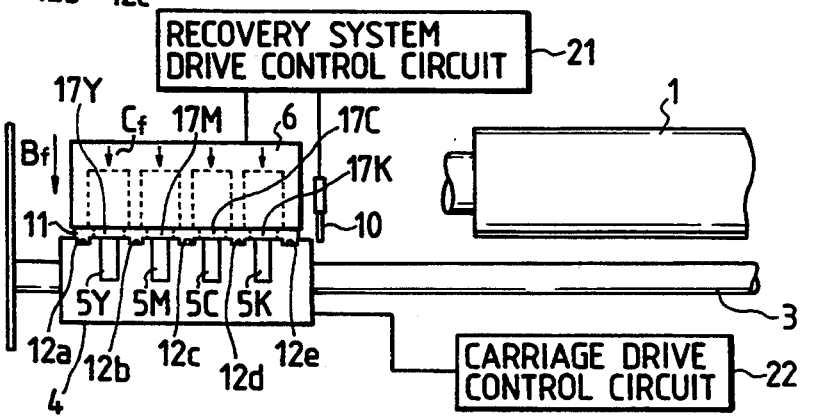

Then, as shown in FIG. 9C, the discharge recovery unit 6 and the caps 17 move forward and come in contact with the recording heads 5 and the carriage 4. A construction of this example is such that as the discharge recovery unit 6 moves forward, the cap members 17 move forward therewith; however, since the absorbing member 11 is positioned ahead of the cap members 17, the absorbing member 11 first comes in contact with the carriage 4. The discharge recovery unit 6 further moves forward for pressing the absorbing member 11 and thereby deforming the absorbing member so that the absorbing member enters the groove portions 12 and also for achieving the contact state between the caps 17 and the heads 5.

In this state, ink in the grooves 12 transfers to the absorbing body 11, and thus, the grooves 12 are cleaned and refreshed. A capping state is maintained until a next recording process is initiated, thereby protecting the recording heads 5 and cleaning the grooves 12.

Figure 9D:
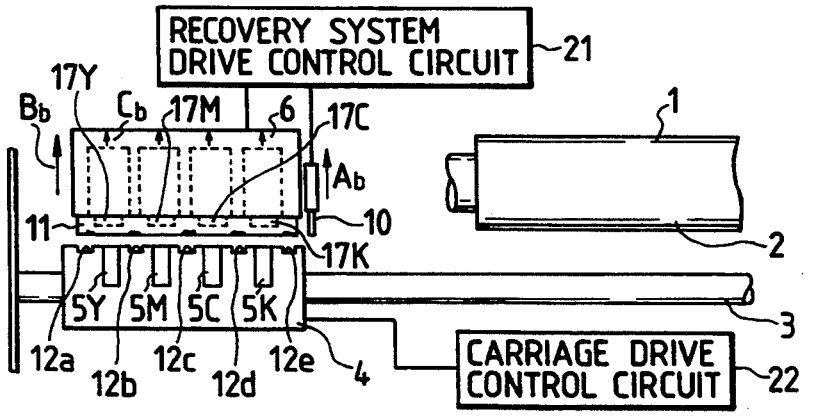

Then, as shown in FIG. 9D, when a next recording process is initiated, the discharge recovery member 6 moves backward for removing the capping state, thereby establishing the state of being ready for recording.

Figure 10:
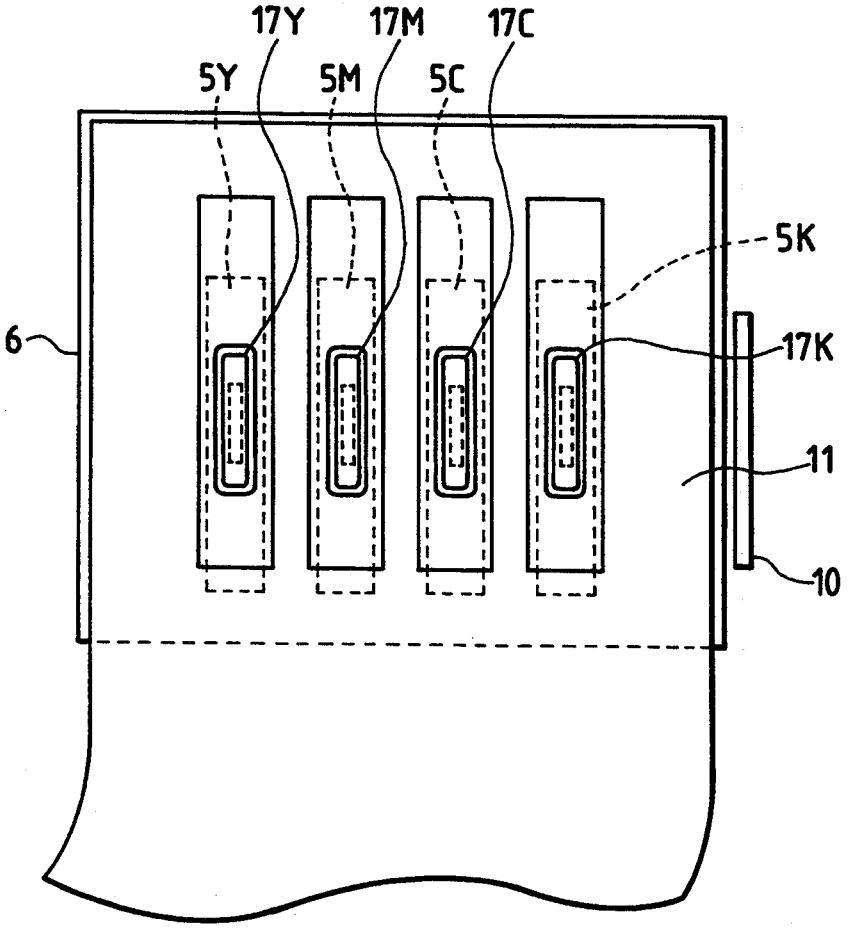
FIG. 10 is a schematic front view as viewed from the front of a discharge recovery unit portion shown in FIG. 7

FIG. 10 shows a positional relation between the absorbing member 11 and the front of the recording heads 5 in the capping state. A solid line designates the absorbing member 11 disposed on the discharge recovery unit 6, and openings are formed in a part of the absorbing member; the caps 17Y, 17M, 17C, and 17K are disposed so as to be seen through the openings. A dashed line designates in what positional relation the recording heads come in contact with the discharge recovery unit 6 in the capping state. As seen from FIG. 10, the lower portions of the recording heads are in contact with the absorbing member 11. This contact is intended to absorb and recover ink and the like which has escaped being wiped off by the blade and has dropped downward.

Such construction prevents ink having dropped along a recording head surface from dropping into a scanning path during recording, thereby preventing the inside of an apparatus from being stained with dropping ink and a recording quality from deteriorating because of ink adhesion to recording paper. Thus, ink is recovered by highly reliable wiping and capping.

A construction of this example is such that only the lower portions of the recording heads 5 come in contact with the absorbing body at the time of capping; however, a construction may be such that both sides of the recording heads 5 come in contact with the absorbing body for absorbing and recovering ink mist and the like.

The absorbing member 11 of this example may be provided only on the front of the discharge recovery unit 6, or may be extended as far as under the home position as shown in FIG. 7 for increasing the amount of ink recovery. By extending the absorbing member 11, the amount of ink absorption can be increased, and a wide ink evaporating area can be secured, thereby preventing the function of the absorbing member 11 from deteriorating over a long term.

As described above, when the present invention is applied to an ink jet color recording apparatus, the wiping member 10 is always cleaned as mentioned in the description of the first embodiment, and consequently, each recording head can maintain good printing over a long term.

When one wiping member wipes out a plurality of recording heads of different colors as in the present embodiment, after wiping the first recording head (51 in FIG. 5) in an upstream position in a wiping direction, a next second recording head (52 in FIG. 5) is wiped; consequently, the ink of the first recording head adhering to the wiping member 10 enters the discharge ports of the second recording head, causing a problem that when printing is conducted with the second recording head after wiping, ink in color mixed with an ink color of the first recording head is discharged. According to an ordinary practice as measures against mixed color printing after wiping, sucking recovery and preliminary discharge are conducted after wiping; however, these measures involve ink consumption, causing the problem of an increase in running cost. However, in a construction of the present embodiment having the groove portions 12 in a carriage and the absorbing body 11, ink removed from the first head 5Y is securely removed from the wiping member 10 at the groove portion **12*b* provided on the downstream side of the first head in a wiping direction; consequently, the mixing of ink colors does not occur when the second recording head 5M** is wiped. Also, since ink accumulating in the groove portions is removed by an absorbing body, a cleaning effect is maintained over a long term. Hence, the construction of the present embodiment prevents mixed color printing after wiping, thereby reducing the execution of sucking recovery and preliminary discharge and thus, suppressing an increase in running cost.

In contrast with a conventional complicated process where a carriage is once brought to a home position, wiping is conducted in a process of the carriage's moving to a recording region, and then, the carriage returns again to the home position for starting recording by ink discharge and the like, this example employs a process where a wiping operation is conducted in a process of a carriage's moving from a recording region to a home position, thereby making quick proceeding to a recording process possible and thus, suppressing a reduction in throughput. Also, since a blade is cleaned concurrently in a wiping process, the cleaning of the blade is also terminated at the time of the termination of wiping; consequently, vibrations which occur when the blade leaves a wiped member (recording head and the like) do not cause ink to splash from the blade.

In our experiment using ink in specified colors (black, cyan, magenta, yellow), a specified recording head (400 dpi, 128 nozzles), and an elastic blade made of polyurethane (0.7 mm in thickness, 10.0 mm in width, 8.0 mm in free length), an endurance test was conducted on a recording apparatus having a recovery unit to which a construction of the present invention is applied, at 1.5 mm in the amount of entry with respect to a head discharge port surface at the time of wiping and 200 mm/sec in a carriage moving speed, by printing 50000 sheets of size A4, individual recording heads' printing image of a recording rate of 75% concurrently, on a cycle of one wiping operation per sheet and one capping operation with every 100 sheets; as a result, no discharge failure such as deviation and nondischarging occurred.

However, as a result of an endurance test on an apparatus under the same conditions as described above except that a mechanism of the present embodiment was removed from a recovery unit, a discharge failure occurred after printing thousands of sheets. Thus, the use of a blade cleaning mechanism of the present invention has brought a great expansion of service life in terms of the number of sheets. As a result of an endurance test under the same conditions as described above except that a mechanism of the present embodiment was removed, mixed color printing occurred after printing tens of sheets, and a discharge failure occurred after printing thousands of sheets. Thus, the use of a blade cleaning mechanism of the present invention brings a great expansion of service life in terms of the number of sheets, and also prevents mixed color printing after wiping, thereby succeeding in constructing an ink jet recording apparatus with low running cost.

[Third embodiment]

Figure 11:
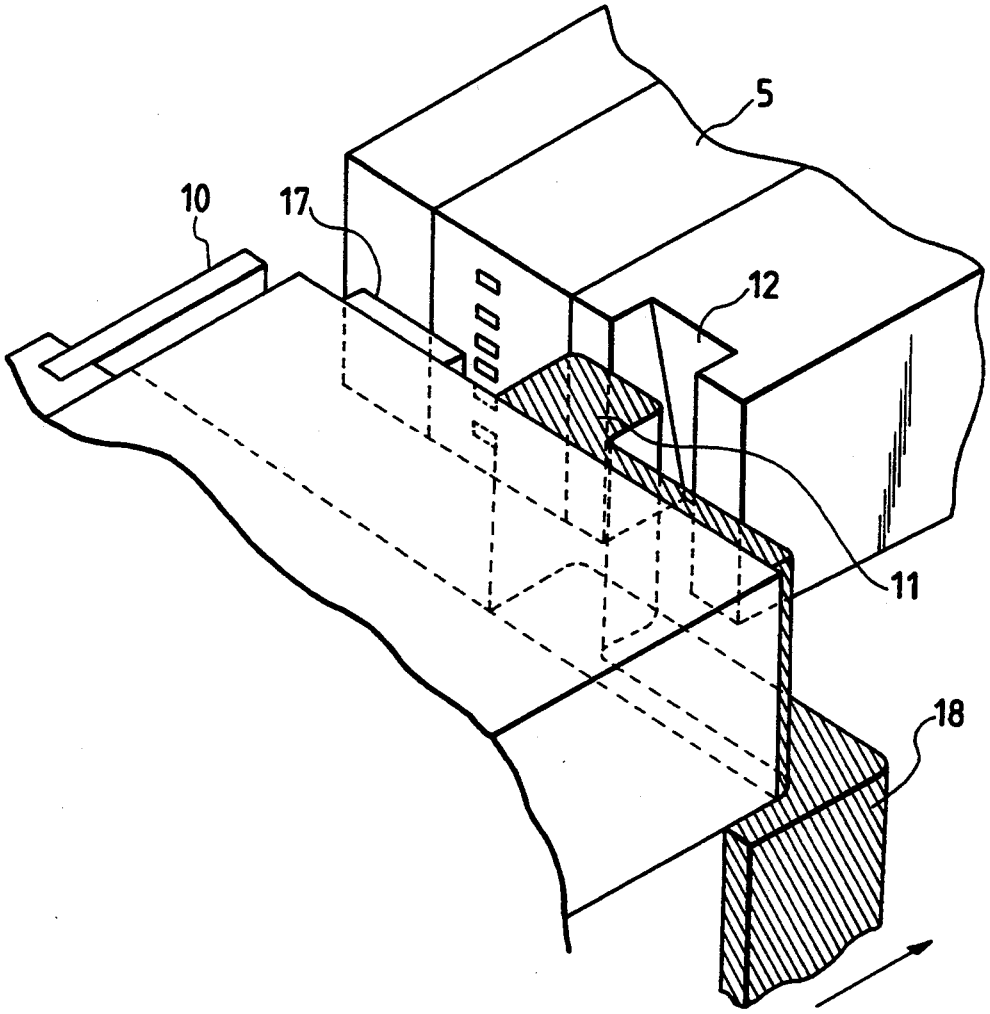
FIG. 11 is a perspective view schematically showing the essential portions of a further embodiment of an ink jet recording apparatus according to the present invention.

FIG. 11 shows a third embodiment. In this example, as shown in FIG. 11, a groove portion 12 provided in a carriage 4 has an inclined surface facing an absorbing body.

When such groove portion 12 and an absorbing body press against each other, ink i transferred to and accumulated in the groove portion 12 is absorbed for removal by the absorbing body 11 pressing against the groove portion at the time of a capping operation; at this time, since the groove portion's surface facing the absorbing body is an inclined surface, the absorbing body is squeezed unevenly. In other words, in this example, the inclined surface is formed such that the groove portion 12 is narrow on the upper side thereof and wide on the lower side thereof; consequently, ink in the absorbing body moves from the upper side causing much squeeze to the lower side causing little squeeze. In addition, in this example, an absorbing body for storing ink 18 is provided in a lower portion, and ink ends up by being collected in the absorbing body for storing ink 18.

The use of a construction of the present embodiment prevents a problem that the overflow of an absorbing body causes the cleaning of a groove portion to become insufficient and consequently, causes the cleaning of a wiping blade to be disabled; moreover, the use of a construction of the present embodiment implements a wiping member cleaning mechanism free from a deterioration in cleaning capability over a long term, thereby making a further improvement in service life in terms of the number of sheets. Needless to say, the construction is applicable to not only one-recording head construction as shown in FIG. 11 but an apparatus having a plurality of heads for color recording.

Also, it is a matter of course that said absorbing body (including an absorbing body for ink storage) may be provided in easily replaceable fashion.

Moreover, an absorbing body may be provided with a tube or the like to be connected through a cap to a pump for generating a negative pressure. Thus, a construction is established that ink absorbed in an absorbing body is recovered, thereby maintaining ink absorbability over a further long term. In addition, the absorbing body 11 used in this example is a porous absorbing body free from the expansion of volume caused by ink absorption.

The present invention brings about an excellent effect, particularly, in recording heads and recording apparatus of such an ink jet recording system that provided is means for generating thermal energy (for example, electrothermal conversion, laser beam, and the like) for use as energy for causing ink discharge, and said thermal energy causes a phase change of ink. Such a system enables recording to be made at high density and high definition. For the typical construction and principle of such a system, it is preferable to use, for example, a basic principle disclosed in U.S. Pat. No. 4,723,129 or U.S. Pat. No. 4,740,796. The system is applicable to either so-called on-demand type or continuous type. In particular, in the case of on-demand type, at least one driving signal causing a sharp temperature rise which corresponds to recording information and exceeds nucleate boiling is applied to an electrothermal conversion body arranged in correspondence with liquid (ink) holding sheet and liquid paths, thereby causing thermal energy to be generated in the electrothermal body and causing film boiling to occur on the heat acting surface of a recording head with a resultant formation of a bubble in liquid (ink) making one-to-one correspondence with the driving signal. The growth and contraction of a bubble causes liquid (ink) to be discharged through an opening for discharge, thereby forming at least one droplet. If the driving signal is in pulse form, the growth and contraction of a bubble is conducted quickly and appropriately, thereby achieving liquid (ink) discharge excellent especially in response performance; therefore, the driving signal in pulse form is more preferable. Signals as described in U.S. Pat. No. 4,463,359 and U.S. Pat. No. 4,345,262 are suited to be used as the pulse-form driving signal. Also, if conditions described in U.S. Pat. No. 4,313,124 for an invention relating to a temperature-rise rate of the heat acting surface described above are used, more excellent recording will be able to be conducted.

A recording head construction of the present invention includes a construction using U.S. Pat. No. 4,558,333 and U.S. Pat. No. 4,459,600 disclosing such a construction that a heat acting portion is disposed in a curved region, in addition to a combined construction of discharge port liquid paths and electrothermal conversion bodies (linear liquid paths or right-angled liquid paths) as disclosed in each patent described above. In addition, an effect of the present invention still works for constructions based on Japanese Laid-Open Patent Application No. 59-123670 disclosing such a construction that a common slit for a plurality of electrothermal conversion bodies is taken as a discharge portion for the electrothermal conversion bodies and Japanese Laid-Open Patent Application No. 59-138461 disclosing such a construction that apertures absorbing pressure waves of thermal energy correspond to discharge portions. In other words, whatever form recording heads assume, the present invention enables recording to be conducted securely and efficiently.

Moreover, the present invention is effectively applicable to a full-line type recording head having a length corresponding to the maximum width of a recording medium recordable on a recording apparatus. Such a recording head may be either of a combined construction of a plurality of recording heads for attaining a required length and a construction of an integrally formed one recording head.

In addition, the present invention is also effective in the case of using a recording head fixed on an apparatus main body, or a replaceable, chip type recording head whose installation onto an apparatus main body establishes electrical connections with the apparatus main body and ink supply from the apparatus main body, or a cartridge type recording head, i.e. a recording head integrally provided with an ink tank, all said recording heads being of a serial type as exemplified above.

For the reason of more stabilizing an effect of the present invention, it is desirable to add to the present invention recovery means for recording head, preliminary auxiliary means, and the like to be provided as a construction of a recording apparatus. Specifically speaking, preliminary heating means of an electrothermal conversion body or another heating element or their combination, and conducting a preliminary discharge mode, i.e. conducting discharge other than recording, are effective for stable recording.

Also, as for the type or quantity of recording heads to be mounted, for example, only one recording head can be provided in correspondence with monochromatic ink, or a plurality of recording heads can be provided in correspondence with a plurality of inks of different recording colors and densities. In other words, the present invention is also quite effective for a recording apparatus having, as a recording mode thereof, not only a recording mode in a main color only, such as black or the like, but at least either multiple-color recording mode in different colors or full-color recording mode in mixed colors, said multiple-color and full-color recording modes being attained either by an integrally constructed recording head or a plurality of recording heads combined.

Furthermore, in embodiments of the present invention described above, ink is described as liquid; however, acceptable is ink that solidifies at a room temperature or below and softens or liquefies at a room temperature, or ink that is in liquid phase at the time of applying a recording signal used, since in an ink jet system, the temperature of ink itself is usually controlled at a temperature ranging from 30° C. to 70° C. for maintaining ink viscosity in a range of stable discharge. In addition, whichever a case may be, i.e. thermal energy is positively used as energy for changing the phase of ink from solid phase to liquid phase for preventing a temperature rise caused by thermal energy, or for preventing ink evaporation, used is ink which solidifies if left as is, the present invention is also applicable to the case where thermal energy applied in accordance With a recording signal causes ink to liquefy, and then the liquefied ink is discharged, and the case where used is ink which does not liquefy until thermal energy is applied thereto, for example, such ink that already begins to solidify at the time of reaching a recording medium. Ink in such cases may assume the form of facing an electrothermal conversion body in the state of being held as liquid or solid in concave portions in porous sheet or apertures penetrating therethrough as described in Japanese Laid-Open Patent Application No. 54-56847 or 60-71260. The present invention is the most effective for each ink described above when a film boiling system described above is executed.

Furthermore, an ink jet recording apparatus of the present invention may assume the form of an image output terminal for information processing equipment such as computers and the like, a copying machine combined with a reader and the like, facsimile equipment having a transmission-reception feature, and so on.

As described above, in an ink jet recording apparatus having a carriage holding a recording head and a wiping member for wiping out the liquid discharge port surface of said recording head, a groove portion, the wiping member sliding against an edge portion thereof, is provided in a portion on one side or both sides of a carriage positioned on the downstream side or upstream side or both downstream and upstream sides of a discharge port in a wiping direction of said wiping member, and provided is an absorbing member having ink absorbing property which comes in contact with said groove portion, thereby constructing an ink jet recording apparatus wherein the wiping member is securely cleaned and a stable discharge characteristic is maintained over a long term.

What is claimed is:

1. An ink jet recording apparatus comprising:

a carriage for mounting a recording head having a discharge port for discharging ink onto a recording medium, said carriage being moveable between a recording area where recording is performed on the recording medium and a non-recording area;

capping means disposed at the non-recording area for performing a capping operation by moving relative to a surface of the recording head at which the discharge port is disposed to cap the discharge port; and cleaning means adjacent said capping means for cleaning the surface of the recording head, wherein said carriage has a recess adjacent the recording head, said recess having a corner edge for scraping any foreign material deposited on said cleaning means when said cleaning means rubs said corner edge after cleaning the head, and wherein an absorbing member is disposed adjacent said capping means so that said absorbing member contacts said recess in a capping operation to collect the foreign material scraped from said cleaning means by said corner edge.

2. An ink jet recording apparatus according to claim 1, wherein said absorbing member has a region in contact with a lower portion of the recording head.

3. An ink jet recording apparatus according to claim 1, wherein said recess has an inclined surface sloping away from said capping means from an upper portion thereof toward a lower portion.

4. An ink jet recording apparatus according to claim 1, wherein said absorbing member extends downward from said capping means to a bottom region of the recording apparatus.

5. An ink jet recording apparatus according to claim 1, wherein said cleaning means cleans the surface of the recording head by movement of said carriage and said recess is disposed downstream of a direction of such movement of said carriage.

6. An ink jet recording apparatus according to claim 1, wherein said recess is in close engagement with said absorbing member.

7. An ink jet recording apparatus according to claim 1, wherein said capping means is movable toward and away from the head independently of said cleaning means.

8. An ink jet recording apparatus comprising:

a carriage for mounting a plurality of recording heads, each of the recording heads having a discharge port for discharging a different ink onto a recording medium, said carriage being moveable between a recording area where recording is performed on the recording medium and a non-recording area;

capping means disposed at the non-recording area for performing a capping operation by moving relative to a surface of each of the recordings heads at which the discharge port thereof is disposed to cap the discharge port; and cleaning means adjacent said capping means for cleaning the surface of each of the recording heads, wherein said carriage has a recess adjacent each of the recording heads, said recess having a corner edge for scraping any foreign material deposited on said cleaning means when said cleaning means rubs said corner edge after cleaning an adjacent recording head, and wherein an absorbing member is disposed adjacent said capping means so that said absorbing member contacts said recess in a capping operation to collect the foreign material scraped from said cleaning means by said corner edge.

* * * * *

UNITED STATES PATENT AND TRADEMARK OFFICE

CERTIFICATE OF CORRECTION

PATENT NO. : 5,381,169

DATED : January 10, 1995

INVENTOR(S) : ATSUSHI ARAI, ET AL.

It is certified that error appears in the above-identified patent and that said Letters Patent is hereby corrected as shown below:

ON TITLE PAGE

In [57] ABSTRACT, line 14: "ink" should read --an ink--.

COLUMN 1

Line 43, "of" should be deleted.

COLUMN 2

Line 12, "over" should be deleted.
Line 29, "thereof" should be deleted.

COLUMN 3

Line 27, "an" should be deleted.

COLUMN 4

Line 12, "being" should be deleted.

COLUMN 5

Line 26, "De" should read --be--.

COLUMN 9

Line 31, "out" should be deleted.

UNITED STATES PATENT AND TRADEMARK OFFICE

CERTIFICATE OF CORRECTION

PATENT NO. : 5,381,169

DATED : January 10, 1995

INVENTOR(S) : ATSUSHI ARAI, ET AL.

It is certified that error appears in the above-identified patent and that said Letters Patent is hereby corrected as shown below:

COLUMN 13

Line 1, "With" should read --with--.
Line 23, "out" should be deleted.
Line 54, "head," should read --recording head,--.

COLUMN 14

Line 27, "head" should read --recording head--.
Line 39, "recordings" should read --recording--.

Signed and Sealed this

Thirteenth Day of June, 1995

*Attest:*

Bruce Lehman

BRUCE LEHMAN

*Attesting Officer*

*Commissioner of Patents and Trademarks*